US005311860A

United States Patent [19]

Doria

[11] Patent Number: 5,311,860

[45] Date of Patent: May 17, 1994

[54] ELECTRIC MASSAGER

[75] Inventor: Alessandro Doria, Milan, Italy

[73] Assignee: Daniels, S.r.l., Milan, Italy

[21] Appl. No.: 838,273

[22] PCT Filed: May 14, 1990

[86] PCT No.: PCT/EP90/00781

§ 371 Date: Mar. 13, 1992

§ 102(e) Date: Mar. 13, 1992

[87] PCT Pub. No.: WO91/04002

PCT Pub. Date: Apr. 4, 1991

[30] Foreign Application Priority Data

Sep. 14, 1989 [IT] Italy ..... 21723/89[U]

[51] Int. Cl.[5] ..... A61H 7/00; A61H 15/00

[52] U.S. Cl. ..... 601/103; 601/113

[58] Field of Search ..... 128/32, 34, 35, 36, 128/41, 44, 56, 57, 59-62 R, 55

[56] References Cited

U.S. PATENT DOCUMENTS

| | | | |
|---|---|---|---|
| 1,012,653 | 12/1911 | Knickerbocker | 128/62 R |
| 2,944,543 | 7/1960 | NewCombe | 128/57 X |
| 2,988,084 | 6/1961 | Douglas | 128/41 |
| 3,754,548 | 8/1973 | McGrath | 128/41 X |
| 4,082,089 | 4/1978 | Moriyama et al. | 128/24.3 |
| 4,149,530 | 4/1979 | Gow | 128/36 |
| 4,505,267 | 3/1985 | Inada | 128/59 X |

FOREIGN PATENT DOCUMENTS

| | | | |
|---|---|---|---|
| 0044107 | 1/1982 | European Pat. Off. | 128/62 R |
| 0229531 | 7/1987 | European Pat. Off. . | |
| 559096 | 9/1932 | Fed. Rep. of Germany . | |
| 1951644 | 4/1971 | Fed. Rep. of Germany . | |
| 758222 | 7/1933 | France . | |
| 191336 | 7/1936 | Switzerland . | |
| 555675 | 11/1974 | Switzerland . | |
| 314282 | 9/1928 | United Kingdom . | |

*Primary Examiner*—Robert A. Hafer
*Assistant Examiner*—Brian E. Hanlon
*Attorney, Agent, or Firm*—Birch, Stewart, Kolasch & Birch

[57] ABSTRACT

An electric massager includes two spaced apart massaging heads provided with a plurality of vibrating finger protrusions and a plurality of vibrating bal protrusions, respectively, such that each of the plurality of protrusions are coplanar and such that the plurality of finger protrusions and the plurality of ball protrusions are vibrated by two respective motors which are either jointly or individually operable.

8 Claims, 2 Drawing Sheets

ELECTRIC MASSAGER

BACKGROUND OF THE INVENTION

1. Field of the Invention

This invention relates to an electric massager primarily intended as a domestic appliance for stimulating blood circulation, invigorating the muscle and skin of a human body, and fighting cellulitis.

2. Description of Related Art

Massagers for domestic use are known, which comprise a hand held body incorporating an electric motor; the motor drives via an eccentric coupling a massaging head having several rounded protrusions. A massager of this kind is disclosed by EP-A-229531.

It is also known from DE-A-0559096 a hand held body massager having two opposite, set apart massaging heads provided with a plurality of vibrating finger protrusions and a plurality of vibrating ball protrusions respectively. One or the other of the massaging heads can be used for the massaging action on the body.

SUMMARY OF THE INVENTION

It is an object of the invention to provide a massager which can apply a more varied massaging action to a concerned part of the human body than the massagers of the above mentioned prior art, being at the same time simple and convenient to operate.

This object is achieved according to the invention of a hand held body massager, comprising a body having two set apart massaging heads provided with a plurality of vibrating finger protrusions and a plurality of vibrating ball protrusions respectively, characterized in that all the protrusions are essentially lying at the same plane and in that the finger protrusions and the ball protrusions are put into vibration by two respective motor means which are individually or jointly operable.

The features and advantages of the invention will become apparent from the following detailed description of a preferred embodiment thereof, given in conjunction with the accompanying drawings.

DETAILED DESCRIPTION OF PREFERRED EMBODIMENTS

Figure 1:
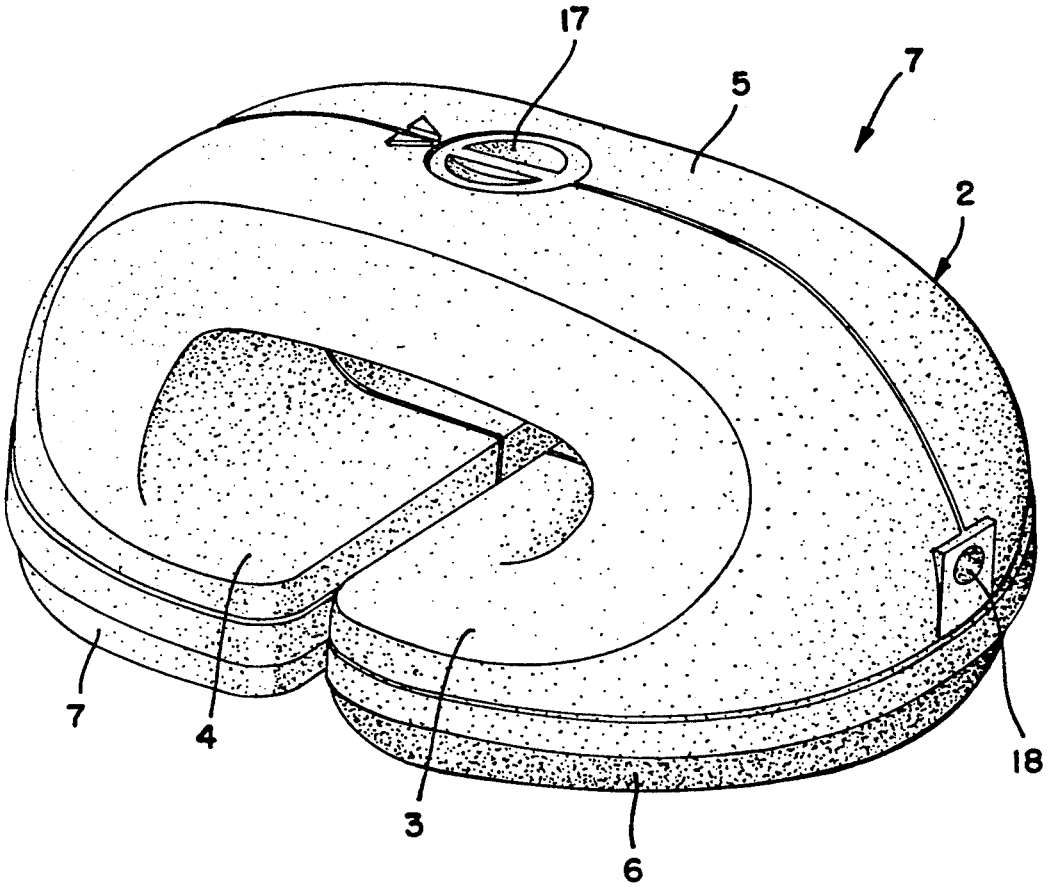
FIG. 1 is a perspective view of a massager according to the invention.
Figure 3:
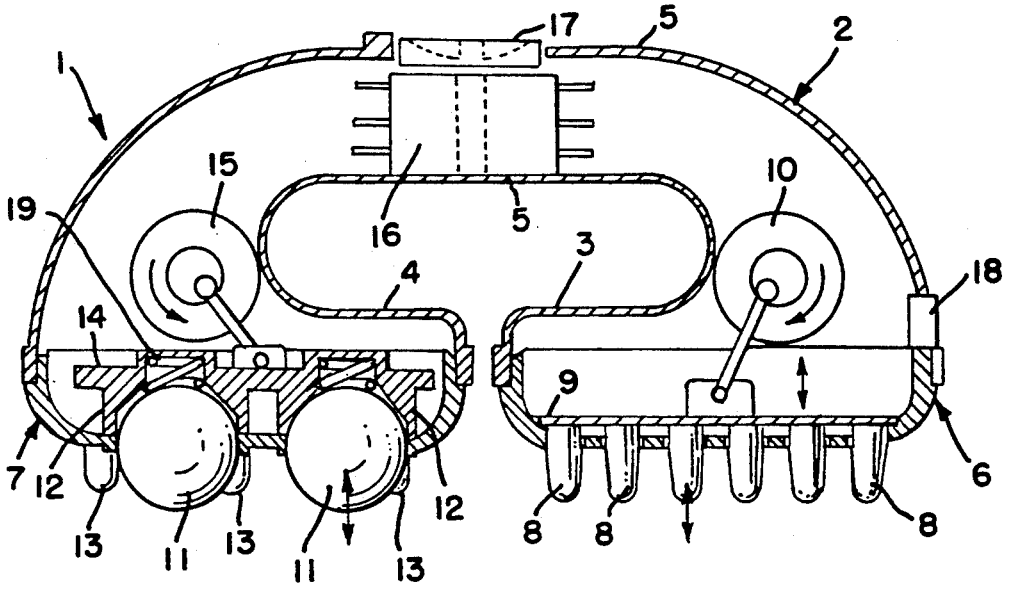
FIG. 3 is a side elevation view, in section, showing schematically the massager of the FIG. 1.
Figure 2:
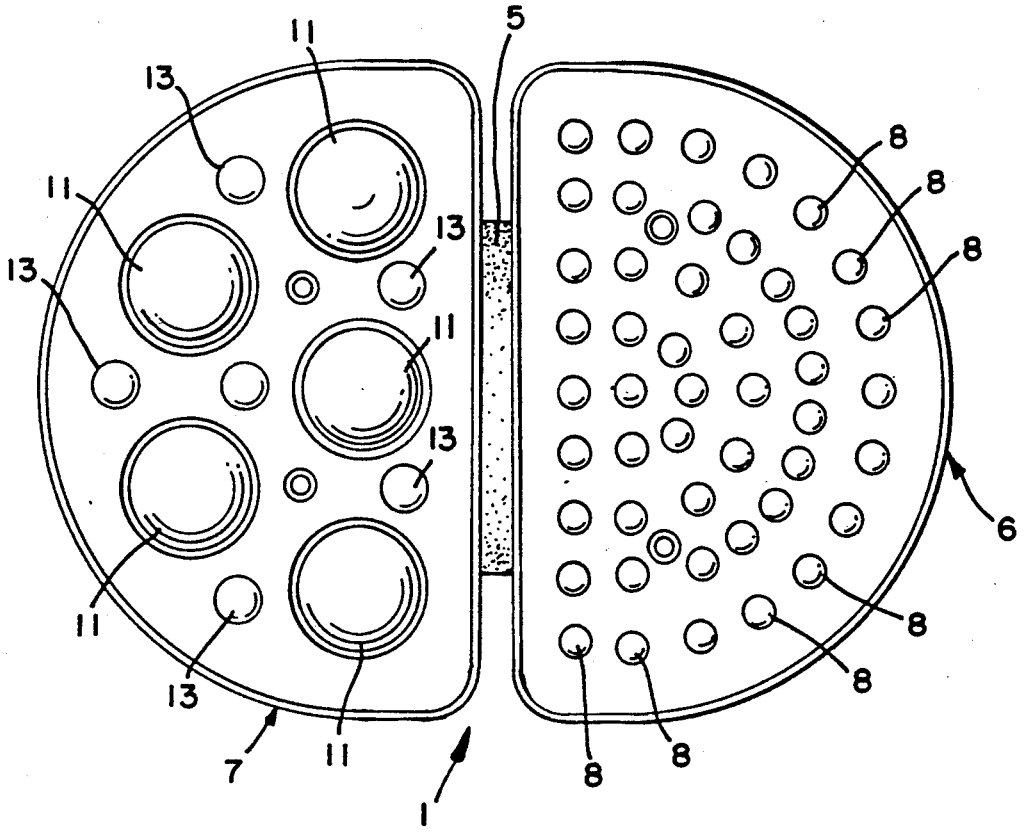
FIG. 2 is a bottom plan view of the massager shown in FIG. 1.

With reference to the drawing views, generally indicated at 1 is an electric massager, particularly a hand held massager intended for household use.

The massager 1 comprises a body 2 made of a rigid synthetic plastics material, of adequate strength and lightweight, which is configured basically as a telephone handset, wherein there are defined two adjacent co-planar end portions 3 and 4 having a flattened, substantially semicircular plan shape, and a bridge middle portion 5 between the end portions 3, 4 which constitutes a handle for the massager 1.

The massager 1 further comprises two massaging heads, indicated at 6 and 7, which are mounted to the body 2 at the end portions 3 and 4 thereof, respectively.

It should be noted that the massaging heads 6 and 7 are held apart by a sufficient distance from each other to allow either of them to be used independently, as explained hereinafter.

In particular, massaging head 6 carries stiff fingers 8 of equal length, extending in perpendicular directions to the working surface of the head and being distributed at regular intervals thereacross.

The fingers 8 fit slidably in respective holes formed in the head 6, at the working surface, and are solidly mounted on a plate 9 at their ends received inside the head. The plate 9 is associated, in turn, with an electric motor means 10 carried on the interior of the head 6 and operative to put the plate 9, and hence the fingers 8, into vibration. Also provided are spring means, known per se and not shown, which intervene between the plate 9 and the working surface of the head 6.

Massaging head 7 is provided with balls 11 which are rotatably and elastically carried in respective holders 12 with the interposition of spring means 19. The balls 11 protrude outwards from the head 7 through respective holes formed in the working surface of the head, and are distributed at regular intervals across the surface.

Secured on the head 7, across the working surface and around the balls 11, are also a plurality of stiff fingers 13 having rounded ends.

The holders 12 for the balls 11 are solidly mounted on a plate 14, which is associated with a conventional electric motor means 15, operative to put the plate 14 and hence the balls 11, into vibration. The fingers 13 are solidly mounted on the end portion 4 of the body 2 and are not put into vibration.

The motor means 10 and 15 may be operated individually or together through a selector switch 16 mounted on the bridge portion 5 and provided with a control knob 17. Also provided is an electric tap 18 connected electrically to the selector switch 16 and the motor means 10, 15 for hooking the massager 1 to the electric outlet.

As for operation of the massager, after plugging in the massager 1, the knob 17 of the selector switch is moved to a position corresponding to the massaging action sought, to activate one or the other of the massaging heads, or both heads simultaneously. Thereafter, holding the body 2 by its bridge portion 5, the selected massaging head(s) is pressed onto a body part to be massaged.

More specifically, the motor means 10 for the head 6 with the vibrating fingers 8 will be activated where a powerful, deep and constant massaging action is desired, with the head 6 held pressed onto the body part concerned for a desired time period.

The motor means 15 for the head 7 with the vibrating balls 11 will be activated instead for a milder massaging action, or across sinuous parts of the body, with the head 7 caused to run across such parts of the body. This action is particularly effective for distributing cream and the like and for enhancing the absorption of the same.

Lastly, by activating both heads 6 and 7, a thorough combined massaging action can be obtained.

The massager of this invention has proved to be quite effective, easy and convenient to use, and to perform in a reliable and safe manner.

I claim:

1. A hand held body massager comprising:

a main body portion;

a first and second massaging heads provided in connection with said main body portion, said first and second massaging heads being spaced apart from each other;

a plurality of finger protrusions operably mounted on said first massaging head and a plurality of ball protrusions operably mounted on said second massaging head, said plurality of finger and ball protrusions all essentially lying in the same plane; and motor means for jointly and separably operating said first and second massaging heads.

2. The massager according to claim 1, wherein the said main body comprises a bridge portion between said first and second massaging heads, the bridge portion constituting a handle for holding the massager.

3. The massager according to claim 1, wherein the plurality of finger protrusions are solidly mounted on a single plate, said plate being movable within said first massaging head.

4. The massager according to claim 1, wherein the plurality of ball protrusions are elastically mounted on a single plate, said plate being movable within said second massaging head.

5. The massager according to claim 4, wherein said second massaging head further includes a plurality of finger protrusions solidly mounted on an end portion of said main body portion and free of movement relative to said second massaging head.

6. The massager according to claim 1, wherein said first and second massaging heads are integrally connected to said main body portion.

7. The massager according to claim 1, wherein said means for jointly and separably operating includes first and second independent motors for said first and second massaging heads respectively, said first and second motors being independently or simultaneously operable to put the plurality of finger and ball protrusions into vibration.

8. The massager according to claim 7, further including a selector switch, connected to said means for jointly and separably operating said first and second massaging heads, for activating at least one of said first and second motors.

* * * * *